US006189690B1

(12) United States Patent
Izen et al.

(10) Patent No.: US 6,189,690 B1
(45) Date of Patent: Feb. 20, 2001

(54) RETAIL PACKAGING FOR SPINNING MUSICAL INSTRUMENT

(75) Inventors: Mark Izen, Chestnut Hill; Brian Connolly, Braintree, both of MA (US)

(73) Assignee: First Act, Inc., Needham, MA (US)

( * ) Notice: Under 35 U.S.C. 154(b), the term of this patent shall be extended for 0 days.

(21) Appl. No.: 09/464,123

(22) Filed: Dec. 16, 1999

Related U.S. Application Data

(60) Provisional application No. 60/113,688, filed on Dec. 24, 1998.

(51) Int. Cl.[7] ..... A45C 11/00

(52) U.S. Cl. ..... 206/314; 206/485; 206/780

(58) Field of Search ..... 206/314, 733, 206/775, 779, 780, 782, 784, 446, 434, 485, 461, 470, 806, 477; 84/411 R, 420, 421, 431, 453; 53/467, 468, 473

(56) References Cited

U.S. PATENT DOCUMENTS

| | | | | |
|---|---|---|---|---|
| 3,651,928 | * | 3/1972 | Weisman | 206/782 |
| 4,126,220 | * | 11/1978 | Roccaforte | 206/782 |
| 5,720,390 | * | 2/1998 | Bostelman | 206/434 |
| 6,016,906 | * | 1/2000 | Kruse et al. | 206/782 |
| 6,059,103 | * | 5/2000 | Izen et al. | 206/314 |

* cited by examiner

*Primary Examiner*—Luan K. Bui
(74) *Attorney, Agent, or Firm*—Bromberg & Sunstein LLP

(57) ABSTRACT

A display package for point-of-purchase display of an article such as a musical instrument sounded by shaking or rotating. The display package has a first opening for facilitating grasping and manipulation of the package by a consumer. A second opening permits sound to be emitted by the instrument. The second opening may be shaped for allowing appendages of the musical instrument to strike a percussion surface of the musical instrument upon rotation of the package.

5 Claims, 2 Drawing Sheets

RETAIL PACKAGING FOR SPINNING MUSICAL INSTRUMENT

This application claims priority from U.S. Provisional Application, Ser. No. 60/113,688, filed Dec. 24, 1998, and herein incorporated by reference.

TECHNICAL FIELD

The present invention relates to a display package for an article with moving parts to which article consumer access is desirable and more particularly for a musical instrument having attached appendages that cause the musical instrument to sound when the instrument is spun.

BACKGROUND OF THE INVENTION

Retail packaging is known which provides some access, on the store shelf, to consumer products. In some cases the access is visual, and in some cases it is possible for the consumer to actually feel the product.

Prior art retail packaging that has allowed a product to be sounded through the packaging has been used for the marketing of drums and is described in U.S. Pat. No. 6,059,103, entitled "Retail Packaging for Musical Instrument." Prior art packaging for instruments and similar products does not allow for motion of any components of the instrument to cause sounding of the instrument nor does it provide one-handed graspability and manipulation of the package by a consumer.

SUMMARY OF THE INVENTION

In accordance with a preferred embodiment of the present invention, there is provided a package for point-of-purchase display of a musical instrument sounded by shaking or rotating. The package has a front panel and a rear panel, each of the front and rear panels being coupled to a side panel. The front and rear panels are substantially parallel and retain the musical instrument between them. An insert is provided for preventing motion of the musical instrument with respect to the package. The package also has a first opening for hand-grasping the package and a second opening for permitting sound to be emitted by the instrument. The second opening may be shaped for allowing appendages of the musical instrument to strike a percussion surface of the musical instrument upon rotation of the package.

BRIEF DESCRIPTION OF THE DRAWINGS

The invention will be more readily understood by reference to the following description, taken with the accompanying drawings, in which.

DETAILED DESCRIPTION OF SPECIFIC EMBODIMENTS

Figure 1:
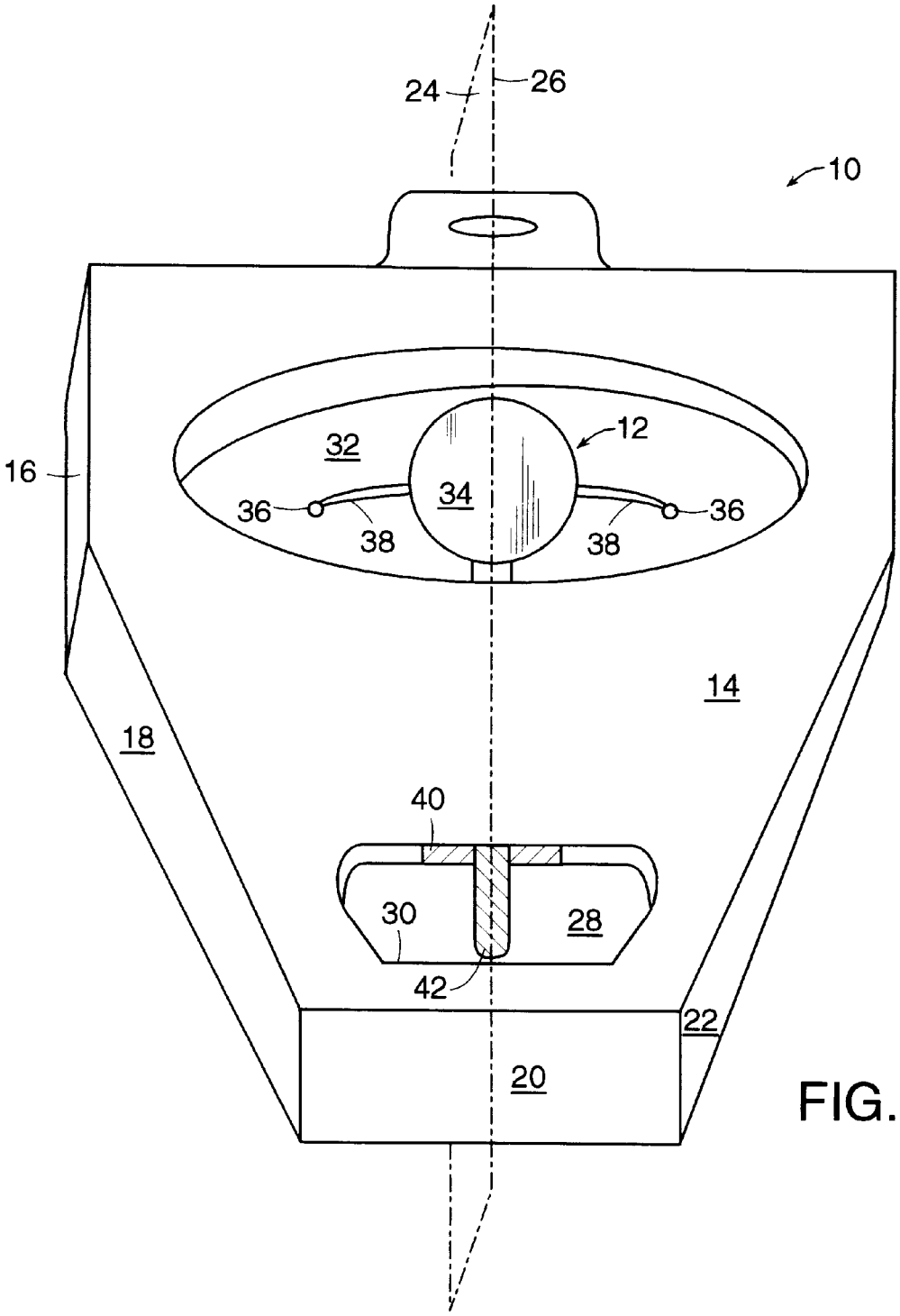
FIG. 1 is a perspective view of a hand-grippable display package in accordance with a preferred embodiment of the present invention.

In accordance with preferred embodiments of the present invention, a display package is provided that allows consumer manipulation of the orientation of the package thereby permitting a musical instrument to be sounded while contained within the package. Referring to FIG. 1, a display package, designated generally by numeral 10, after complete folding and assembly, is a three-dimensional structure that retains a product, shown by way of example as a musical instrument 12, to which consumer access at the point of sale is desirable. As an example, display package 10 is advantageously suited to the display of a musical instrument such as a drum or musical shaker of various kinds. FIG. 1 shows display package 10 containing a drum 34, by way of such an example, though it is to be understood that various articles of commerce, particularly musical instruments, may be advantageously contained and displayed within display package 10. The folded or otherwise assembled display package 10 has a rear panel (not shown) and a front panel 14. Front panel 14 is substantially parallel to the rear panel, with the spacing between the panels provided by side panels 16, 18, and 22, and end panel 20, so as to provide a cavity of sufficient dimensions interior to the panels to contain musical instrument 12.

Package 10 is preferably symmetric with respect to left-right reflection about plane 24 and also with respect to 180-degree rotation about line 26, such that the rear panel (not shown) is identical to front panel 14. Front panel 14 and the rear panel each contain an aperture 28 with lower edge 30 disposed within a palm's breadth of end panel 20 to allow a consumer to comfortably grasp package 10 by inserting fingers into aperture 28 and holding end panel 20 against the heel of the hand. By grasping package 10 in this manner, the consumer may control any motion of the package and may readily shake or rotate the package and the musical instrument 12 retained within the package. Aperture 28 may be shaped as a trapezoid with rounded comers as shown in FIG. 1. The shape of aperture 28 is not limited, however, to that of a trapezoid, and any shape of opening that provides for the customer to grasp package 10 is within the scope of the present invention as described herein and as claimed in any appended claims.

A second aperture 32 is provided in each of the rear panel and front panel 14. Second aperture 32 advantageously allows sound to be emitted by instrument 12. Additionally, for an instrument 12 which is sounded by percussion of drumhead 34 by beads 36 attached to the instrument by cords 38, second aperture 32 allows beads 36 to be swung out of package 10 so as to strike drumhead 34 and sound the instrument. As evident to a person of ordinary skill in the art, an instrument having an integral clapper of any other sort may similarly be allowed to sound within a display package by practice of the present invention. Additionally, the invention may advantageously be employed in the display of a consumer product having appendages that extend out of the packaging during operation. Aperture 32 may be shaped as an ellipse as shown in FIG. 1. The shape of aperture 32 is not limited, however, to that of an ellipse, and any shape of opening that provides for sounding of instrument 12 is within the scope of the present invention as described herein and as claimed in any appended claims.

In accordance with alternate embodiments of the present invention, hand-graspable package 10 may advantageously be employed for displaying other consumer articles, including, for example, instruments containing internal beads or pellets for sounding against a surface in the manner of a rattle.

Package 10 is preferably shaped for convenient manipulation by a consumer. For example, side panels 18 and 22 may advantageously be tapered to meet end panel 20, thereby reducing the size, weight, and wind resistance of the packaging.

Additionally, a central insert 40, otherwise referred to as a "collar shelf," may be provided for retaining instrument 12, such as by preventing motion of instrument handle 42, as shown. While front panel 14 and the rear panel are substantially parallel and may prevent motion of a displayed article from shifting in a direction perpendicular to the front and rear panels, collar shelf 40 retains the displayed article with respect to lateral motion, i.e., motion having a component in a tangential direction to either of front panels 14 and the rear panel. End panel 20 and a top panel (not shown) may be used to retain the displayed product with respect to shifting along axis 26.

Figure 2:
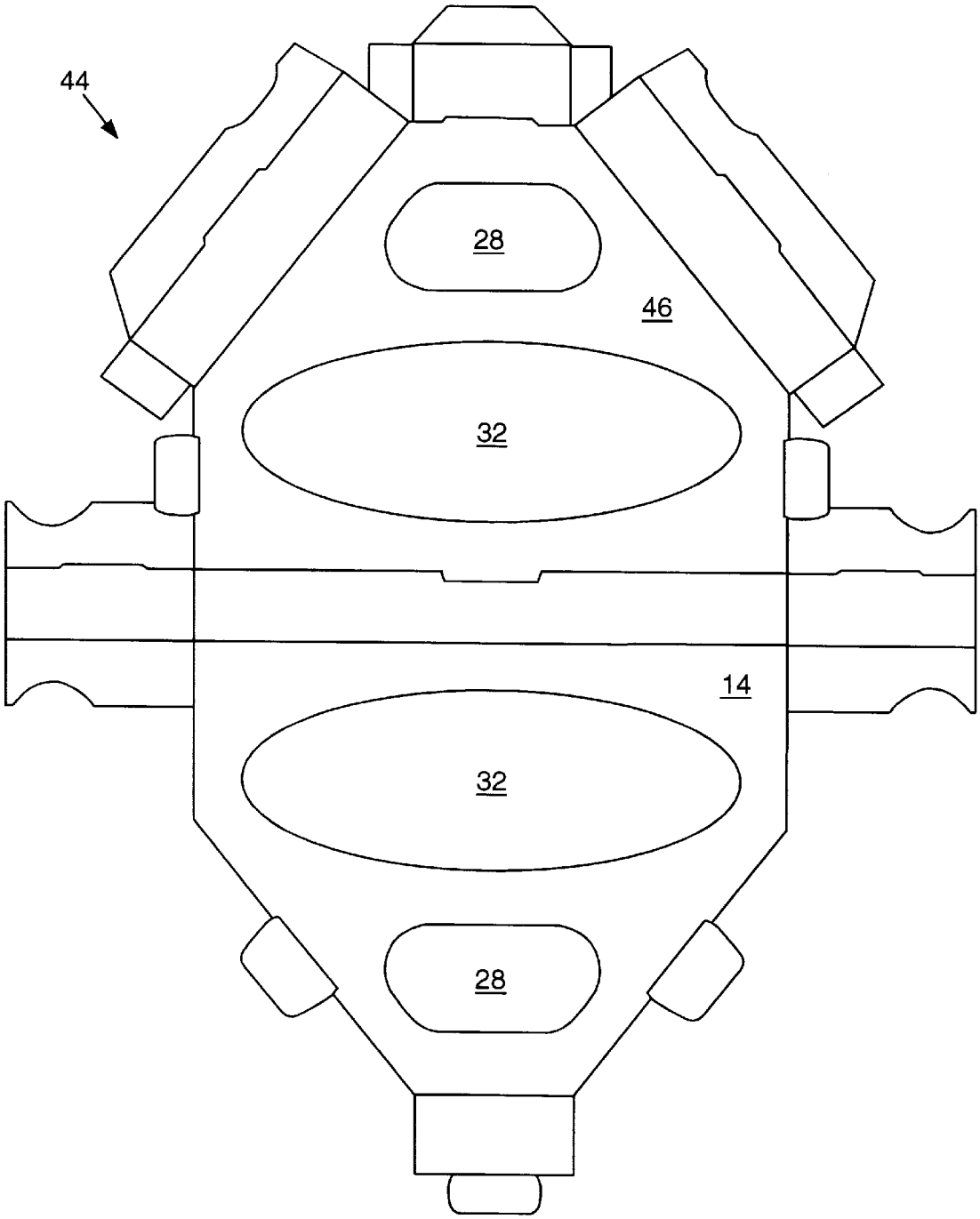
FIG. 2 is a view of a cut and scored blank for forming the display package of FIG. 1.

Display package 10 is preferably constructed from corrugated cardboard or other similar material assembled from a blank in sheet form into a three-dimensional shape by folding. However other materials may be employed within the scope of the present invention as described herein and as claimed in any appended claims. FIG. 2 is a view of a cut and scored blank 44 for forming the display package of FIG. 1. Front panel 14 and rear panel 46 are shown to contain corresponding apertures 28 and 32.

In accordance with alternate embodiments of the invention, additional articles, including instrument accessories or other instruments, may be accommodated with the display packaging, such as by providing additional retaining openings within the collar shelf.

The described embodiments of the invention are intended to be merely exemplary and numerous variations and modifications will be apparent to those skilled in the art. All such variations are intended to be within the scope of the present invention as defined in the appended claims.

What is claimed is:

1. A package for point-of-purchase display of a musical instrument having a percussion surface, the package comprising:

a. a musical instrument having a percussion surface and at least one bead coupled to a cord for striking against the percussion surface;

b. a front panel and a rear panel, the front and rear panels being substantially parallel, the musical instrument engaged between the front and rear panels;

c. a first opening in the front panel accommodating fingers of a consumer for facilitating grasping of the package by the consumer;

d. a second opening in the front panel for permitting the bead of the musical instrument to strike against the percussion surface of the musical instrument so as to emit sound from the percussion surface of the instrument; and e. a collar shelf, coupled to at least one of the front and the rear panels, for preventing motion of the instrument in a direction having a component tangential to the top panel.

2. A packaged musical instrument according to claim 1, further including a side panel for spacing the front panel with respect to the rear panel.

3. A packaged musical instrument according to claim 1, wherein the first opening is substantially trapezoidal.

4. A packaged musical instrument according to claim 1, wherein the second opening is substantially elliptical.

5. A method for displaying a musical instrument having at least one bead coupled to a cord for striking a percussion surface of the musical instrument at a point-of-sale, the method comprising:

a. retaining the instrument within a cavity of a display package, the display package having a rear panel, a front panel, and a collar shelf;

b. providing a first opening in the front panel for consumer grasping of the package; and c. providing a second opening in the front panel for permitting the bead of the musical instrument to strike against the percussion surface of the musical instrument so as to emit sound from the percussion surface of the instrument.

* * * * *